US009498067B2

(12) United States Patent
Gloeckl

(10) Patent No.: US 9,498,067 B2
(45) Date of Patent: Nov. 22, 2016

(54) SEAT DEVICE

(75) Inventor: Josef Gloeckl, Kirchheim (DE)

(73) Assignee: AERIS GMBH, Haar (DE)

( * ) Notice: Subject to any disclaimer, the term of this patent is extended or adjusted under 35 U.S.C. 154(b) by 42 days.

(21) Appl. No.: 13/697,647

(22) PCT Filed: May 16, 2011

(86) PCT No.: PCT/EP2011/057905
§ 371 (c)(1),
(2), (4) Date: Nov. 13, 2012

(87) PCT Pub. No.: WO2011/141580
PCT Pub. Date: Nov. 17, 2011

(65) Prior Publication Data

US 2013/0057038 A1 Mar. 7, 2013

(30) Foreign Application Priority Data

May 14, 2010 (DE) ..... 10 2010 020 503

(51) Int. Cl.
*A47C 9/00* (2006.01)
*A47C 7/02* (2006.01)

(52) U.S. Cl.
CPC ..... *A47C 9/002* (2013.01); *A47C 7/024* (2013.01)

(58) Field of Classification Search
USPC ..... 297/314, 195.11, 461, 201
See application file for complete search history.

(56) References Cited

U.S. PATENT DOCUMENTS

| | | | | |
|---|---|---|---|---|
| 270,273 | A | 1/1883 | Yount | |
| 606,818 | A * | 7/1898 | Best | 297/201 |
| 3,481,628 | A * | 12/1969 | Blaho et al. | 280/283 |
| 4,541,668 | A * | 9/1985 | Rouw | 297/201 |
| 4,736,983 | A * | 4/1988 | Furbee | 297/209 |
| 4,997,232 | A * | 3/1991 | Johnsen | 297/209 |
| 5,324,174 | A * | 6/1994 | Diotte | 417/234 |
| 5,911,430 | A * | 6/1999 | Wuschke | 280/283 |
| 5,913,568 | A * | 6/1999 | Brightbill et al. | 297/258.1 |
| 6,106,064 | A * | 8/2000 | Hibberd | 297/314 |
| 6,340,207 | B1 * | 1/2002 | Brightbill et al. | 297/258.1 |
| 6,595,586 | B2 * | 7/2003 | Brightbill et al. | 297/312 |
| 6,866,340 | B1 * | 3/2005 | Robertshaw | 297/312 |
| 7,350,865 | B2 * | 4/2008 | Pearse | 297/312 |
| 7,416,253 | B2 * | 8/2008 | Kim | 297/312 |
| 7,494,181 | B2 * | 2/2009 | Tucker | 297/201 |
| 7,547,067 | B2 * | 6/2009 | Keilhauer et al. | 297/313 |

(Continued)

FOREIGN PATENT DOCUMENTS

| | | |
|---|---|---|
| DE | 42 10 134 A1 | 9/1993 |
| DE | 195 04 121 A1 | 8/1996 |

(Continued)

*Primary Examiner* — David E Allred
(74) *Attorney, Agent, or Firm* — Scully Scott Murphy and Presser

(57) ABSTRACT

A seat device is provided. The seat device has a foot part, an intermediate piece that is connected to the foot part, and a seat that is connected to the intermediate piece and is formed by two individual seat halves. The seat halves can be moved independently of each other. A coupling device is provided between the seat and the intermediate piece. The seat halves can be moved horizontally in a translatory manner by the coupling device.

11 Claims, 14 Drawing Sheets

(56) References Cited

U.S. PATENT DOCUMENTS

Figure 1:
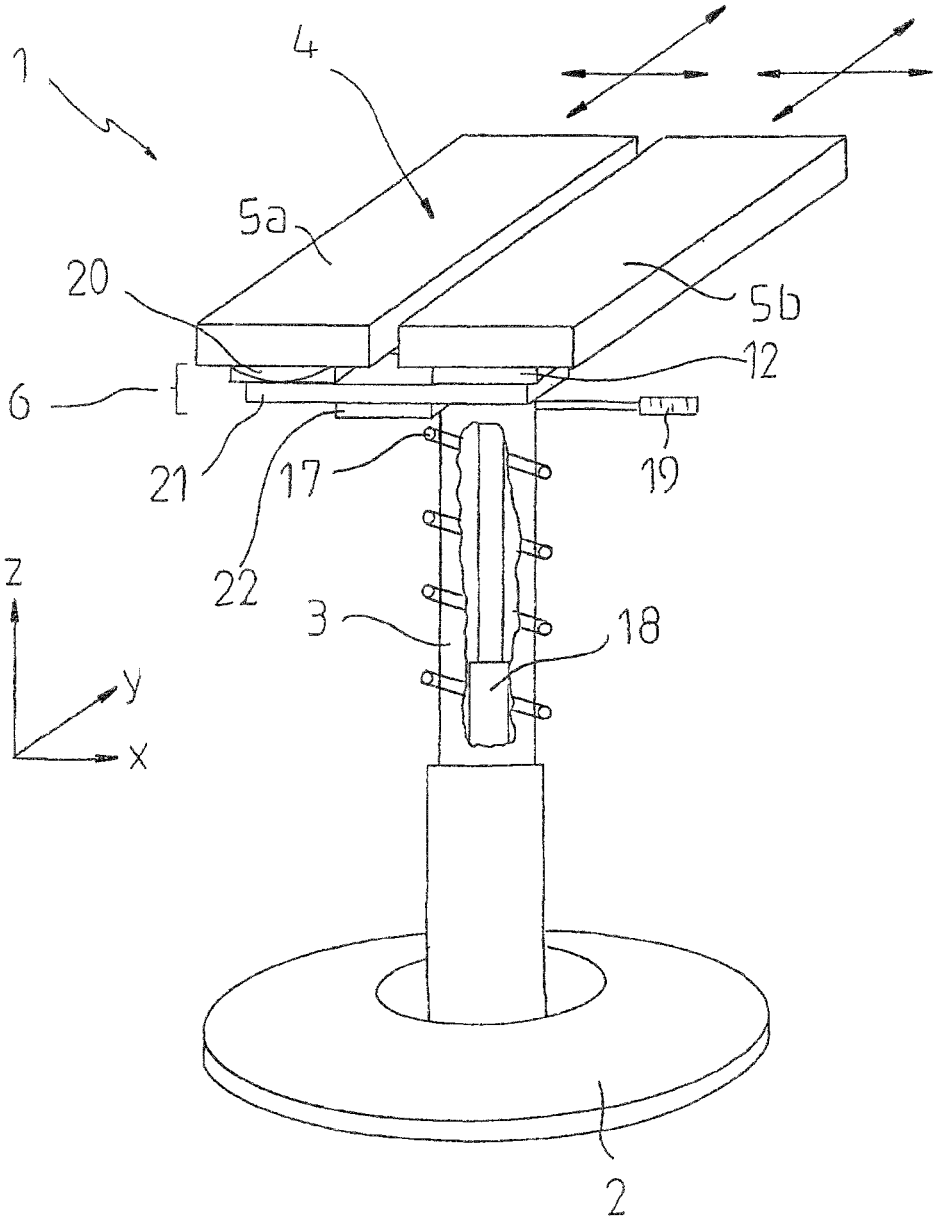

| | | | | |
|---|---|---|---|---|
| 8,540,314 | B2 * | 9/2013 | Fernandez | 297/314 |
| 2002/0171272 | A1 | 11/2002 | Iusim | |
| 2008/0054689 | A1 | 3/2008 | Tucker | |
| 2009/0001788 | A1 * | 1/2009 | Lenz et al. | 297/217.4 |
| 2013/0306831 | A1 * | 11/2013 | Keen | A47C 7/506<br>248/599 |
| 2014/0132051 | A1 * | 5/2014 | Freedman | A47C 7/024<br>297/312 |
| 2015/0173515 | A1 * | 6/2015 | Freedman | A47C 7/024<br>297/314 |
| 2016/0073786 | A1 * | 3/2016 | Walker | A47C 7/563<br>297/325 |

FOREIGN PATENT DOCUMENTS

| | | |
|---|---|---|
| DE | 100 35 473 B4 | 3/2006 |
| WO | 00/09386 A1 | 2/2000 |

* cited by examiner 9
21
14
31
25
5a
30
140
32

5a
21
29
13
34
7
9
z
x
y

SEAT DEVICE

The invention relates to a seat device consisting of a foot part, an intermediate piece connected to the foot part and a seat that is connected to the intermediate piece and formed by two individual seat halves, the seat halves being movable independently of each other, and a coupling device being provided between the seat and the intermediate piece.

PRIOR ART

An active-dynamic seat device which comprises a foot part and an intermediate piece connected to the foot part is known from DE 42 10 134 A1. A seat which is formed in two parts is arranged on the intermediate piece. The two seat-part halves are connected to the intermediate piece independently of each other by vertical springs and each comprises a support part on which a seat half is positioned on a joint in a movable manner such that it can be tilted forwards and backwards.

A seat with a shell-shaped seat component and a back component to support the back is also known from DE 100 35 473 B4, the back component being pivotally mounted around an axis running parallel to the user's spine. The seat component is connected to the pivotal back component by means of a coupling component, the coupling component transferring a rotational movement of the backrest to a lateral rotational movement of the seat component proportionally around the dorsoventral axis and vice versa.

During normal walking the pelvis moves three-dimensionally, i.e. it executes both rotations around all spatial axes and translations in the direction of the spatial axes. When changing from walking to sitting, at least one translational and one rotational degree of freedom are blocked in the described seat designs. The load on the spine or the intervertebral discs also changes with such a change in position. Thus the compressive load when walking changes to a compressive and tensile load when sitting, the intervertebral discs on the dorsal side being subjected to a tensile load and those on the ventral side being subjected to pressure. The greatest load thus occurs in the intervertebral discs in the region of vertebrae S1-L4, as curvature is at its maximum at this point when sitting compared with when standing, Vertebrae L4-L5 are joined to the sacrum and are deprived of their natural mobility when spinal curvature and blockage of degrees of freedom interact. As a result individual intervertebral discs may wear and degenerate prematurely. This in turn leads to backache and in some cases permanent damage to the intervertebral discs. The natural three-dimensional pelvic movement with its six movement options (three rotations around the spatial axes and three translational movements) is thus blocked.

The object of the invention is to provide a seat device which avoids the specified disadvantages of traditional seats and in particular permits three-dimensional pelvic movement.

The seat device according to the invention consists of a foot part, an intermediate piece connected to the foot part and a seat that is connected to the intermediate piece and formed by two individual seat halves. The seat halves are able to be moved independently of each other, a coupling device being formed between the seat and the intermediate piece, which comprises at least one means of moving the seat halves by a translational movement in all spatial directions and rotationally around all spatial axes.

The concept according to the invention entails providing the opportunity, when sitting to execute unlimited three-dimensional pelvic movements. The lumbar vertebrae and the pelvis are thus not blocked in their natural movement, but can be moved in both a translational and a rotational manner in all directions. The advantageous effect of the inventive coupling device lies substantially in the fact that negative loads during sitting are replaced by dynamic movements of the lumbar spine and the pelvis, which movements correspond to those experienced when walking.

When sitting, the majority of the body's weight is borne by the ischial tuberosities.

To ensure maximum possible seat comfort, it is preferable to arrange at least one such means under each seat half. This makes it possible to provide optimum support for both of the pelvic ischial tuberosities when sitting. This also permits a wide variety of sitting positions and promotes wellbeing and mobility during sitting in any position and posture.

The at least one means also favourably comprises at least one elastic and/or damping component. This makes simple adaptation to the anatomical position of the ischial tuberosities of every seat user possible.

The elastic and/or damping component preferably consists of a rubber block which ensures mobility and also provides a soft support for the pelvis. Alternatively, the elastic and/or damping component is designed as a fluid-filled chamber, especially a gel cushion, the component permitting translational displacement in the direction of the spatial axes and/or rotation around the spatial axes, like the rubber block. Alternatively it is also possible to create the component from hydraulic cylinders. The benefits are the same as in the other embodiments.

In a particularly preferred embodiment a component is arranged beneath each seat half, both components being connected such that they communicate with each other. This means that pressure on one component beneath one seat half is transferred to the other seat half, as in a water bed. The same pressure is thus applied in each component, the pelvic position and personal seating requirements acting as controlling factors.

Alternatively it is also possible to form the elastic component as a spring arrangement, in which the arrangement may consist of spiral springs, with the result that a mounted seat half can also be moved in three dimensions. In this case the springs can be mounted inwards at various angles in order to guarantee lateral stability.

In a further particularly preferable embodiment of the invention, the coupling device comprises a mechanism for adjusting the spacing between the seat halves. As people of different ages and sexes have different distances between their ischial tuberosities, this fact is thus taken into account. As a result, such a seat device is suitable for men and women, irrespective of their age. The mechanism may for example have a hand wheel which can be rotated to adjust the spacing in a simple fashion.

In another embodiment a coupling device comprises at least one sliding region which permits horizontal displacement. It is advantageous to provide at least one sliding area per seat surface in this case. In addition, the at least one sliding area is favourably designed as a linear guide, the seat surface and the coupling device being guided by a dovetail guide for example. They may also be guided by means of rollers.

In addition, it is advantageous if the coupling device comprises at least one tilting mechanism for at least one seat half. Tilting is preferably only possible around a dorsoventral axis, but may also deviate from the dorsoventral axis in the case of a special design. This thus counteracts pelvic outflare, in which the ischial tuberosities are pressed inwards and the iliac wings are pushed apart, as a biomechanical countermovement. In biomechanical terms it is better to press the ischial tuberosities outwards on the seat surface and thus move the iliac wings inwards (inflare). In biomechanical terms this leads to a slight anterior concave curvature in the lumbar spine, which corresponds to the natural posture.

It is also advantageous if the position of at least one seat half can be pre-adjusted with respect to the other half and/or restricted in terms of its mobility by means of an adjustment mechanism positioned on the coupling device and/or on the tilting mechanism. This is also advantageous because men and women have different spacings between their ischial tuberosities. In this way it is possible to adjust the inclination or pelvic movement with regard to both intensity and deflection, in accordance with personal and or therapeutic requirements. The seat can also be adjusted to the respective age of the sitter as younger people are generally more mobile than older people.

In order to support constant changes in position, the seat device advantageously comprises a reset mechanism which at least returns the seat half to an initial position. To ensure that the reset mechanism operates correctly, it is favourable to position this between one seat half and the coupling device. Each seat half preferably comprises such a reset mechanism.

In a particular embodiment the seat device may comprise a facility with which the force to change the position of a seat half in and around all spatial directions can be adjusted. The user's requirements with regard to pelvic movement can thus be satisfied precisely. This also makes it possible to treat misalignments of the pelvis caused by hip operations for example. Such a treatment can specifically train the muscles by adjusting the reset force in the sitting position. Individuals who sit at work can thus alleviate their pain. As a result the seat device according to the invention is not only able to help relieve pain, but can also promote the healing process.

The reset mechanism preferably comprises a spring and/or a tension strap. The individual seat halves can thus be reset simply and the reset force can be regulated by the tension of the spring or tension strap.

In a particularly advantageous embodiment, the seat device is a rocking stool. Such rocking stools are known from DE 195 04 121 for example, which permit a spring-mounted to-and-fro movement of the seat, the seat rocking around a pendulum joint which is positioned in a foot part. If the seat device according to the invention is positioned on a foot part with a pendulum joint, this thus provides the seat user with further degrees of freedom and mobility options. In particular, such an arrangement recreates in the sitting position the natural, three-dimensional movement of the pelvis during walking, not only facilitating but also promoting diffusion in the intervertebral discs.

In a further embodiment it is advantageous if the mobility of the seat device can be restricted by means of variable stops. This allows individuals with limited hip mobility to slowly acclimatise to increased mobility. Such a stop can thus prevent overloading or a feeling of insecurity occurring in less mobile seat users due to the high mobility of the seat device, especially in the arrangement on a rocking stool.

In a further preferred embodiment, the coupling device is mounted such that it can rotate on the intermediate piece. Rotational movements around the body axis are thus also possible.

It is also advantageous if the seat halves provide a device with which the seat halves which can be moved independently of each other can be blocked. Individuals who Find a high level of mobility of the seat halves unpleasant can thus still use a seat device in accordance with the above-mentioned features, but for a limited time.

To ensure a correct seat position, it is advantageous if the seat device records the seat position by means of at least one sensor and preferably comprises a facility for providing feeback on this.

This can prevent a "hollow" or concave arrangement forming between the two seat halves as a result of the three-dimensional mobility of the seat device when sitting. As explained above, in biomechanical terms this would lead to the ischial tuberosities moving closer together or to outflare of the upper rim of the pelvis, causing the lumbar spine to experience a slight anterior concave curvature. This should be avoided as the lumbar spine naturally displays a slight posterior concave curvature when standing. A convex tilted seat surface arrangement therefore supports the correct natural body posture, in which the ischial tuberosities tend outwards and inflare of the upper rim of the pelvis tends to occur, promoting an appropriate posterior concave curvature of the lumbar spine.

The sensors may advantageously record all movements of the seat surfaces. It is particularly preferable if the sensors can detect tilting, angular rotation and translational movements. Pressure sensors are also possible. It is thus possible to record the current position of the ischial tuberosities.

The seat device may comprise optical, acoustic and/or haptic elements to notify The user that the seat surfaces are correctly adjusted. Haptic elements may send feed-back to a seated individual by means of vibrations, whereas acoustic elements can generate a warning signal, for example. In the case of an optical message to the seat user, different coloured lights may for example be used, whereby the different arrangements of the seat surface are each displayed by one light colour respectively.

Thus, in the case of a concave inclination of the seat surfaces, a red signal displays an undesirable pelvic position, a horizontal or convex inclination triggering a green light signal. Excessive convex inclination of the seat surfaces in turn leads to an undesirable seating position and is displayed by an orange light. A white light is provided to indicate synchronous inclination of the seating surfaces.

Sensors with corresponding feedback may accordingly also be used to adjust the optimum spacing between the seat surfaces.

The sensors for providing this feedback are also ideally connected to a computer which makes the user aware of his seat position by means of software. They are connected by a cable or wirelessly for example.

The seat device with sensors is also favourably suited to controlling software, (e.g. a computer game) or hardware (e.g. a lifting platform).

Advantageous embodiments and features are presented in the following description of embodiments which are explained in greater detail in conjunction with the drawings, like reference numerals referring to like components.

Figure 2A:
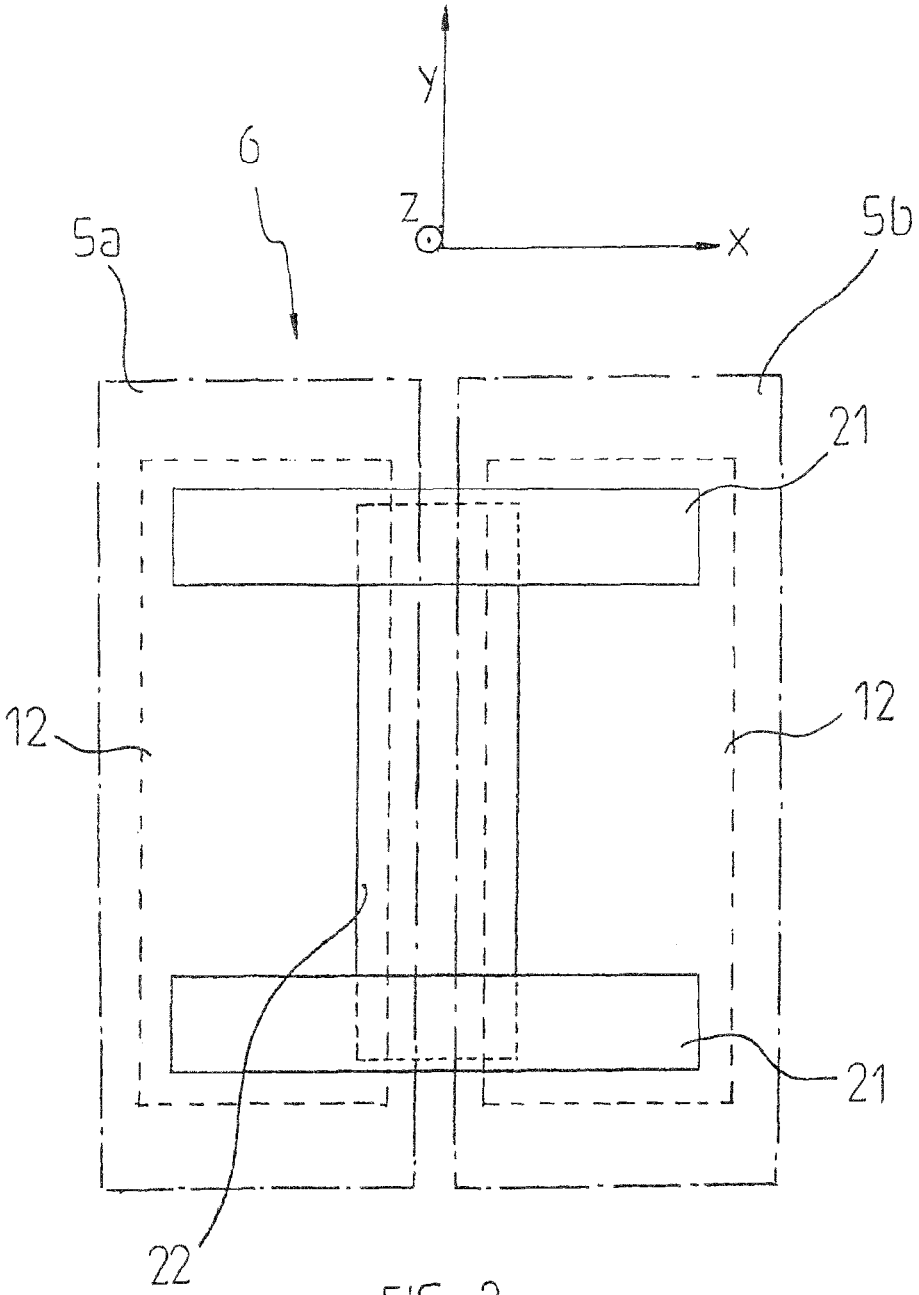
Figure 2B:
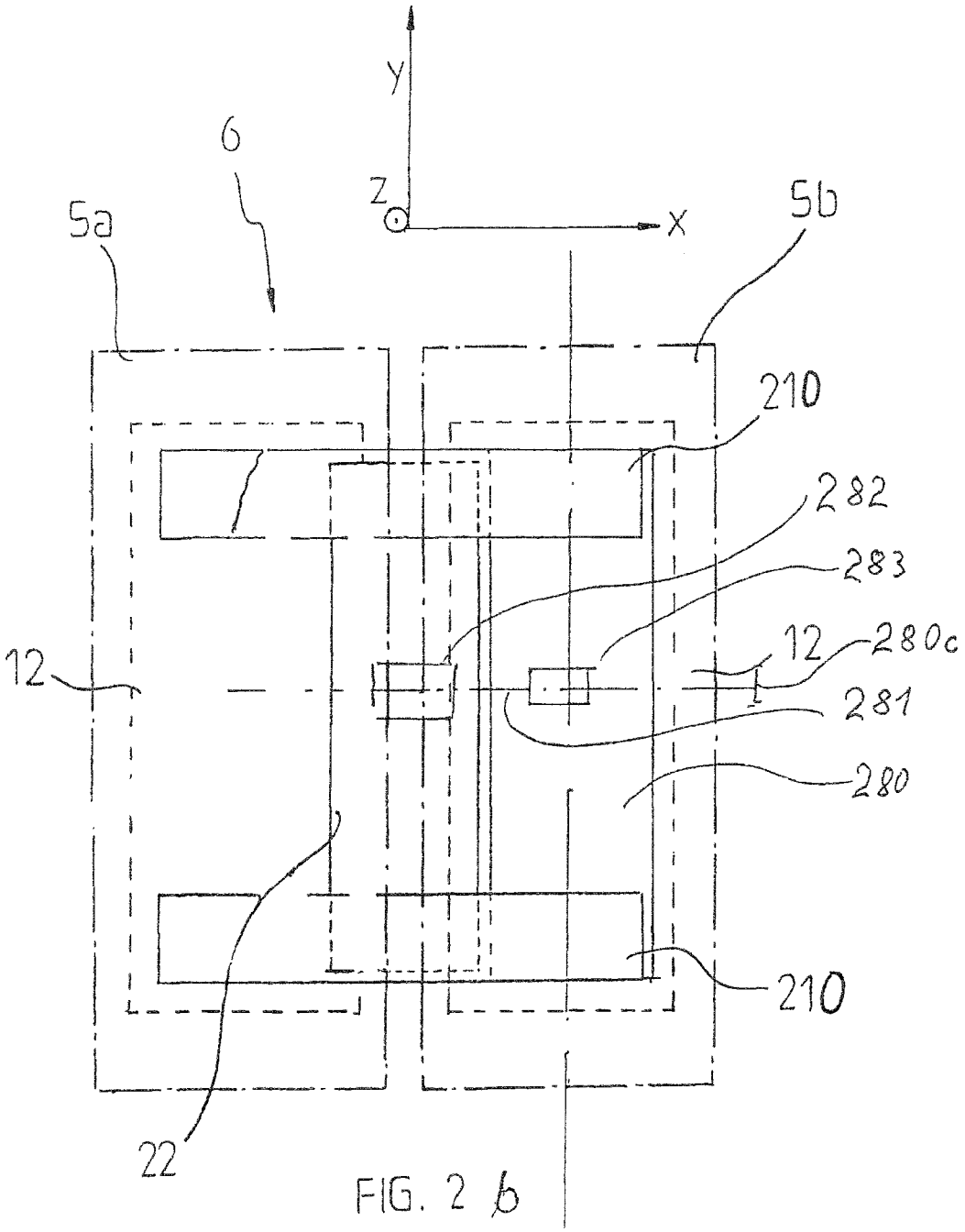
Figure 2C:
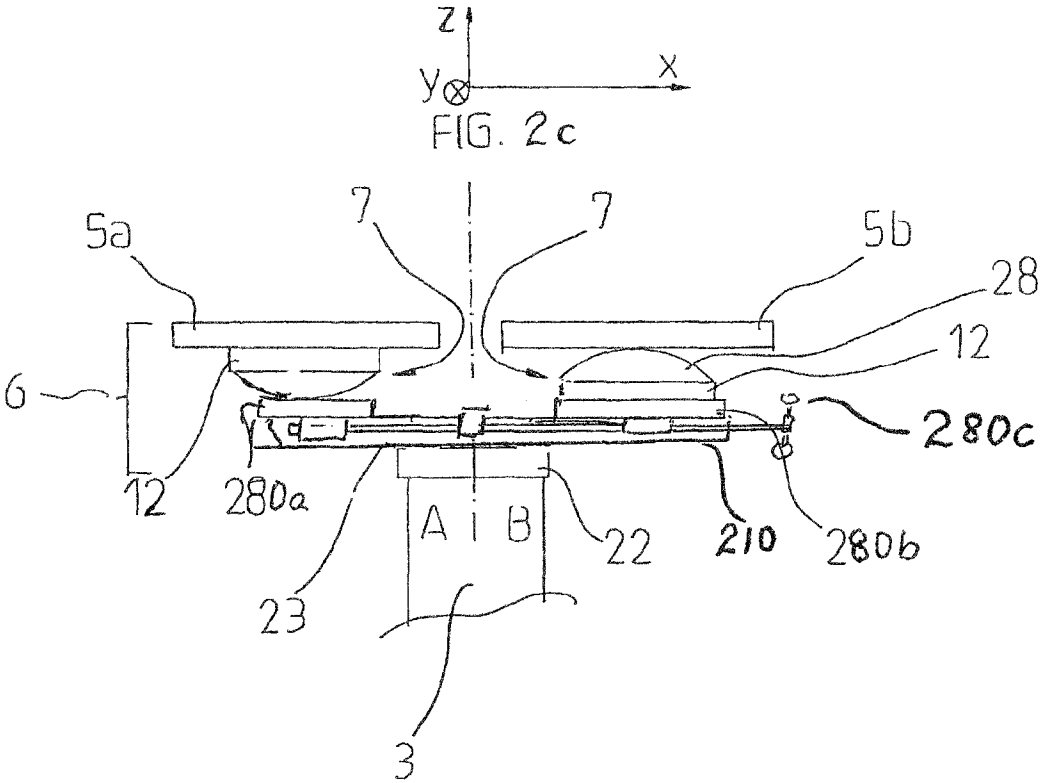
Figure 2D:
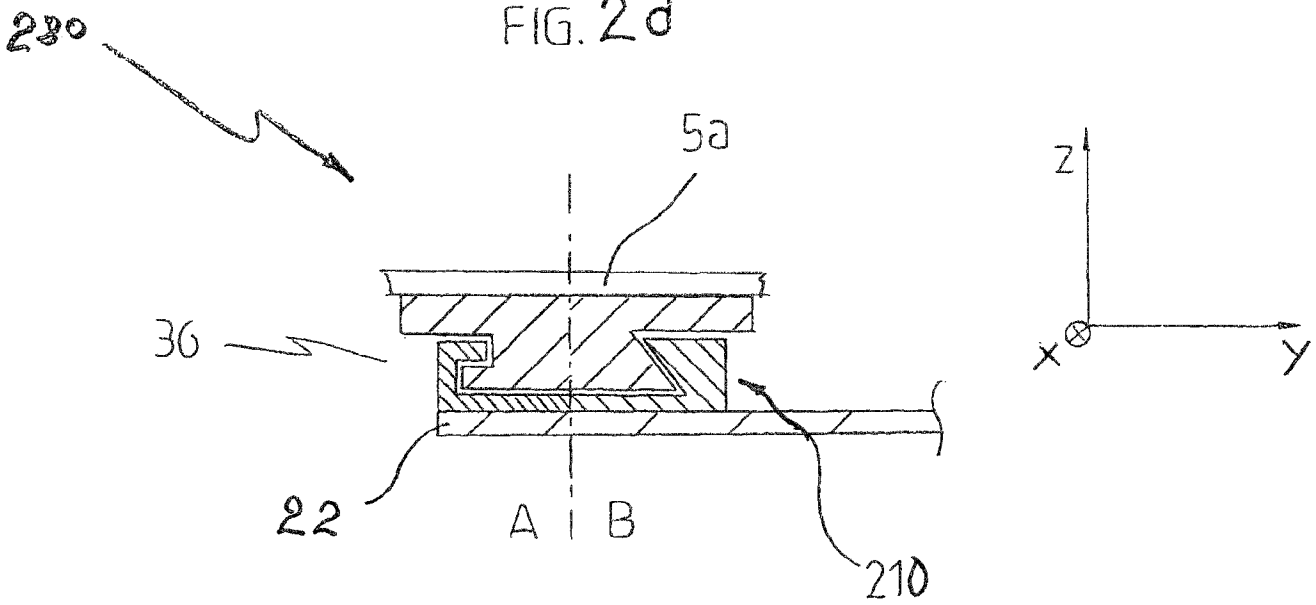
Figure 3A:
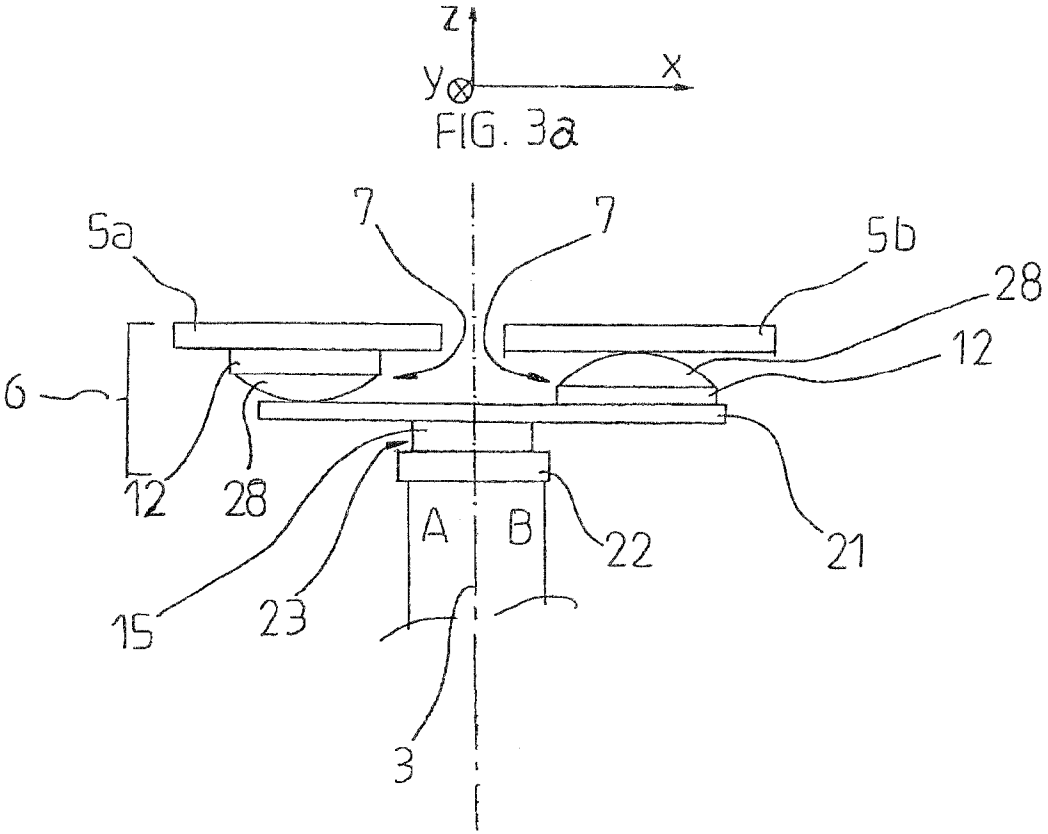
Figure 3B:
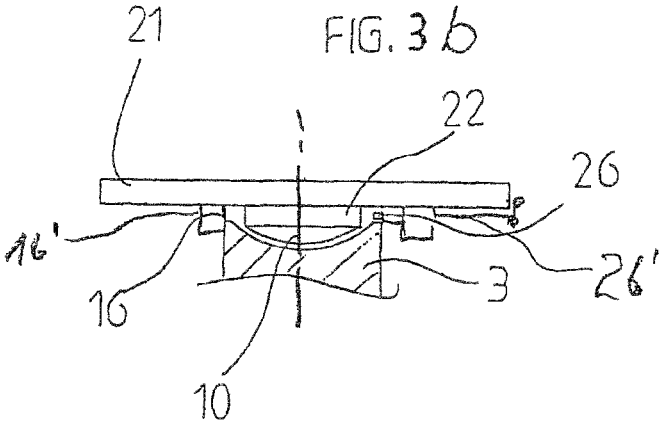
Figure 4:
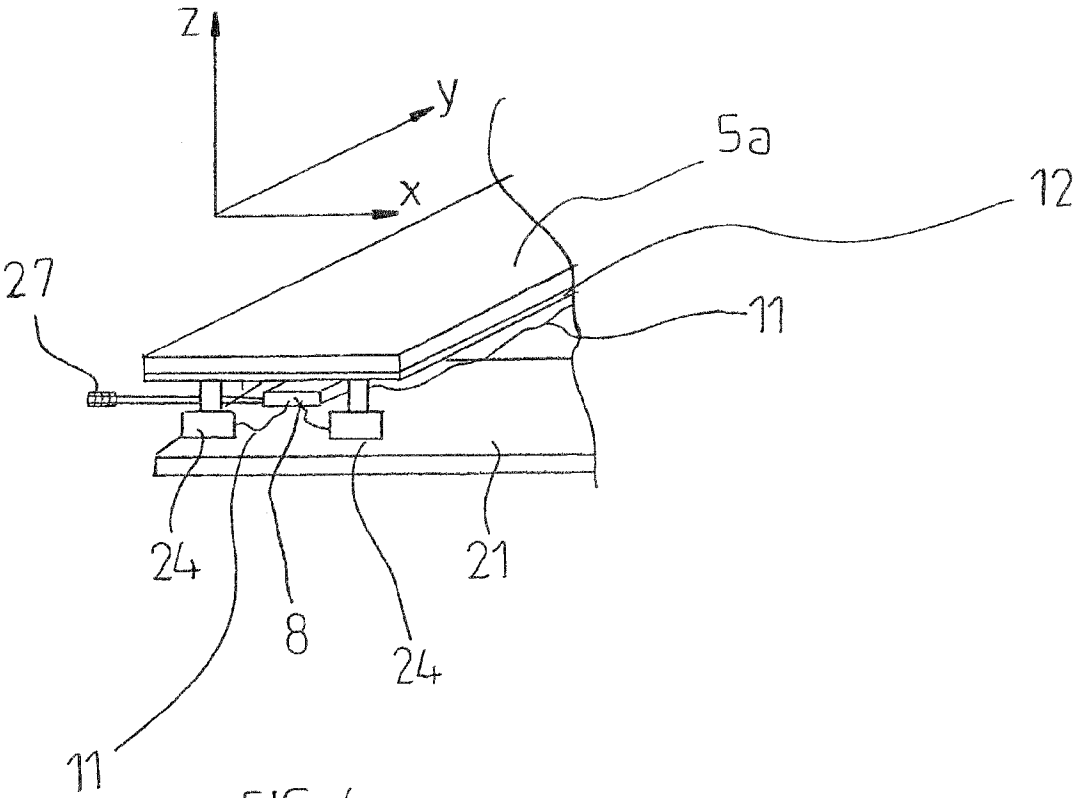
Figures 5, 6A:
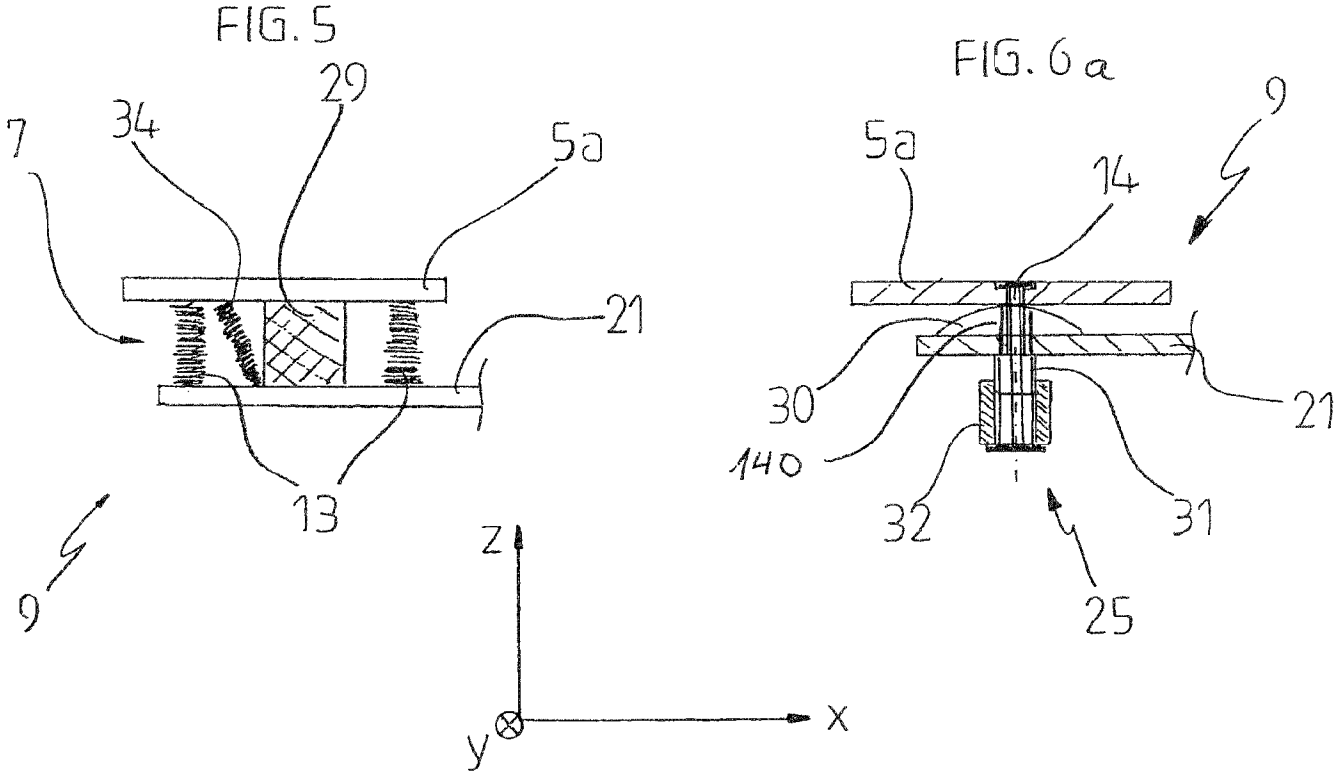
Figure 6B:
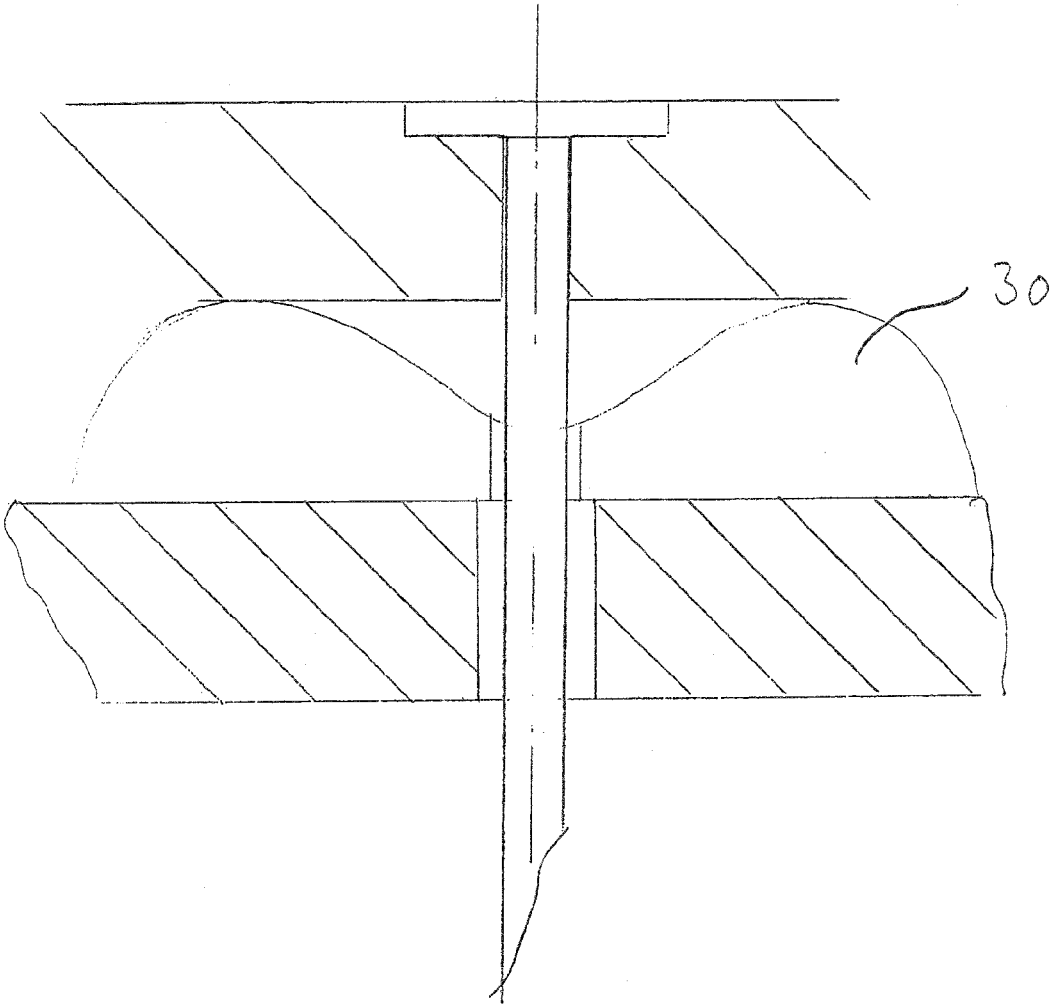
Figure 7:
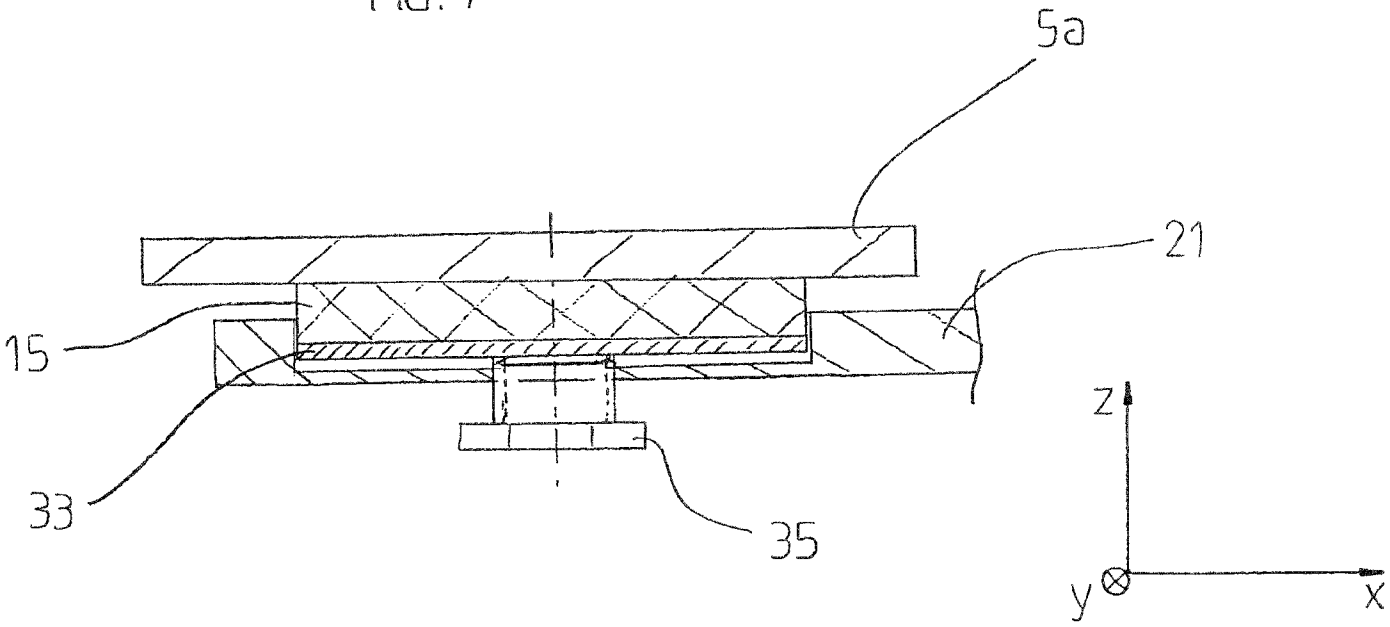
Figure 8:
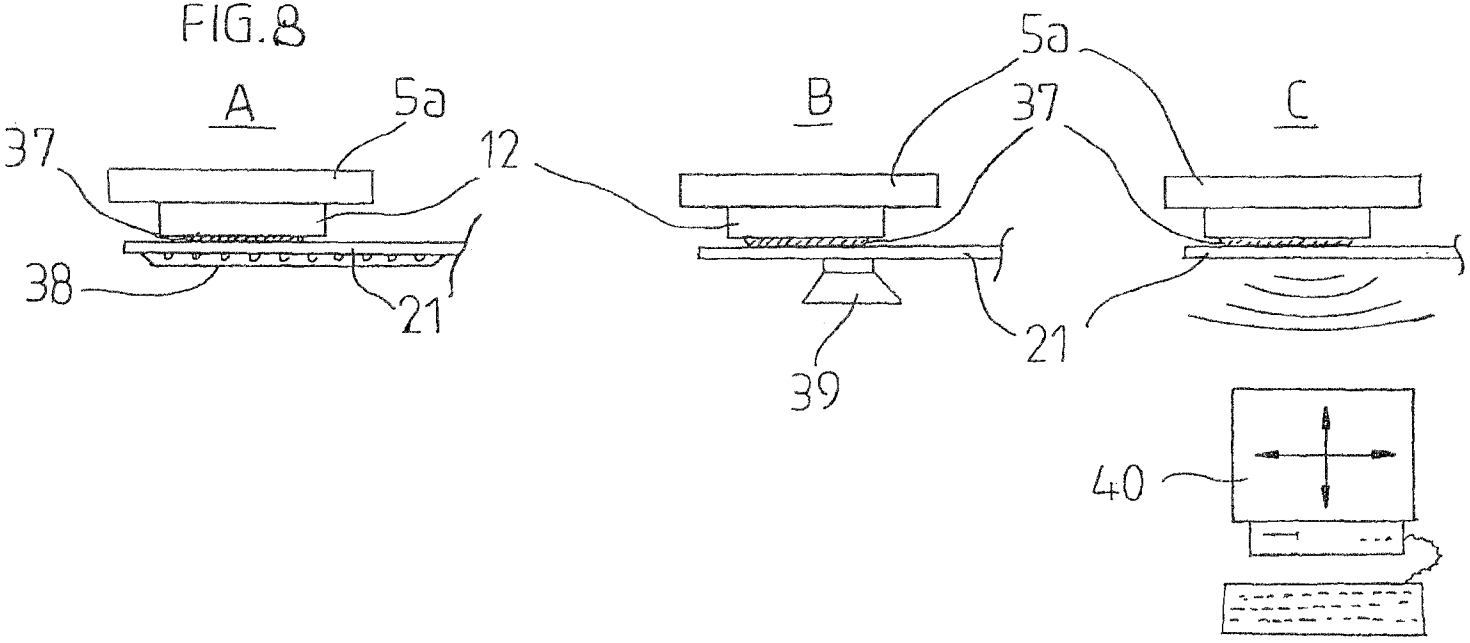
Figure 9:
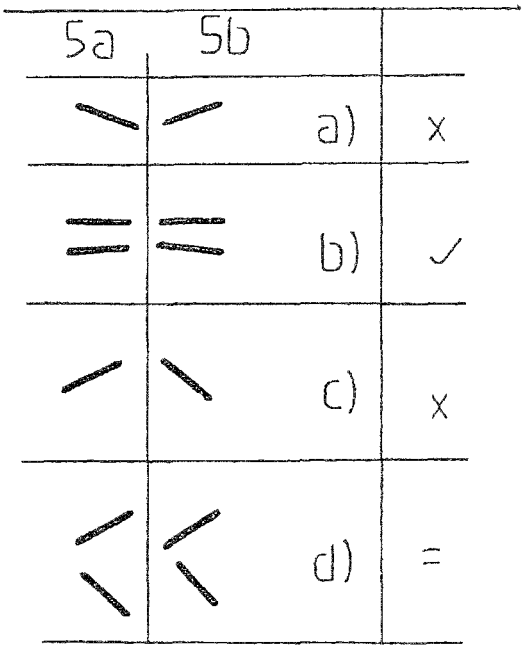
Figure 10:
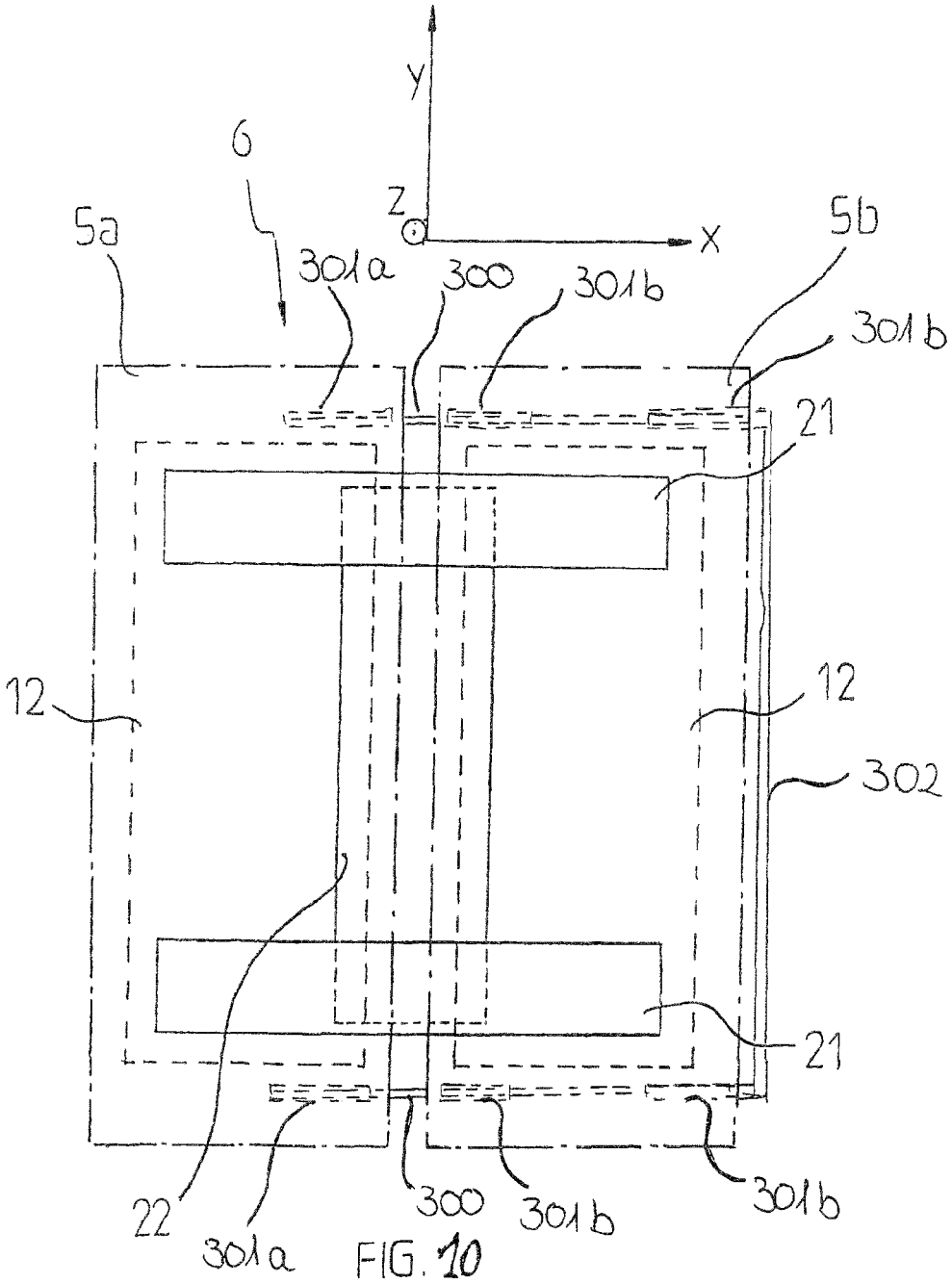

Brief description of the drawings, in which:

FIG. 1 is a view of a seat device from diagonally above,

FIG. 2*a* is a view of the seat device or a coupling device from above,

FIG. 2*b* is a view of the seat device or a coupling device in an alternative embodiment from above, FIG. 2*c* is a sectional view through an embodiment of a linear guide for one seat half, FIG. 2*d* is a side view of the seat device with two seat halves in a different embodiment with a slide arrangement, FIG. 3*a* is a side view of the seat device with two seat halves in a different embodiment, FIG. 3*b* is a side view of the seat device with a joint, FIG. 4 is a tilting mechanism for a seat half, FIG. 5 is another embodiment of a tilting mechanism and a reset mechanism, FIG. 6 is a seat half with another embodiment of a reset mechanism, FIG. 7 is a seat half with an adjustable coupling device, FIGS. 8 A, B and C are each embodiments of a seat half with sensors, and FIG. 9 is a table showing different adjustments for the seat halves, FIG. 10 is an embodiment of a locking device for the seat halves.

DETAILED DESCRIPTION OF THE EMBODIMENTS SHOWN IN THE DRAWINGS

FIG. 1 is a schematic illustration of a seat device 1 with a foot part 2, a columnar intermediate piece 3 connected to the foot part and a seat 4 that is connected to the intermediate piece 3. The spatial x-y-z axes of the coordinate system are selected such that the z axis points upwards in the column of the intermediate piece 3. The seat 4 is formed by two individual seat halves 5*a*, 5*b*, the seat halves being movable independently of each other. A coupling device 6 is positioned between the seat 4 and the intermediate piece 3.

The coupling device 6 consists of a longitudinal support 22, transverse supports 21 and a component 12 which is positioned directly beneath each seat half. The component 12 consists of a material which stores mechanical forces in the form of a deformation and assumes its original form again once the applied forces have been removed. Suitable materials include rubber, foam or gel (gel cushion) for example. It may also be formed in the same way as a water bed. By taking up shear, tensile and compressive forces and moments, this component guarantees three-dimensional mobility of the seat halves in the x-y-z coordinate system.

A semi-cylindrical component 20 with its axis extending in the Y direction is located with its outer surface on the transverse supports 21 in the illustrated embodiment.

This is connected tightly to the seat half 5*a*, all mobility options or rotation around the spatial axes being unimpaired, as shown by the double arrows. Seat half 5*b* has an alternative embodiment without a component 20. This thus enables seat half 5*b* to rotate three-dimensionally in the space, i.e. in the direction of all three spatial axes, and around all spatial axes.

A spring 17 which surrounds the outside of the columnar intermediate piece 3 permits spring-mounted sitting or swinging up and down. A pneumatic spring 18 is located in the intermediate piece 3 for height adjustment purposes, activation of this spring being adjusted by means of a lever 19 underneath the coupling device 6. The intermediate piece 3 is designed to be telescopic (not illustrated) for height adjustment and suspension purposes. It is also possible to position a pendulum joint between the intermediate piece 3 and the foot part 2.

FIG. 2*a* is a view from above the coupling device 6. In this view the seat halves 5*a*, 5*b* are indicated by dashed and dotted lines. The two transverse supports 21 extending in the x direction are spaced apart from each other and connected by means of a longitudinal support 22. The longitudinal support 22 is positioned directly or indirectly on the intermediate piece 3. The component 12 which extends in the y direction and protrudes both over the transverse support 21 and over the longitudinal support 22 in the x and y direction is positioned on the transverse supports 21 and beneath the seat halves in the case of each seat half 5*a*, 5*b*. A narrower component 12 may be used, depending on its unwinding characteristics. However, the width of the component 12 should be selected such that rotation around all spatial axes and translation in every spatial direction are possible. To this end the component 12 is designed as a rubber block, foam block, gel cushion or a fluid-filled chamber (similar to a water bed). The component 12 may also consist of two individual parts, at least one component 12 being attached per seat half and per transverse support 21.

Embodiments of a seat half adjustment are shown in FIGS. 2*b* to 2*d*. It is advantageous to make the spacing between the seat halves 5*a*, 5*b* adjustable due to the fact that the spacing between the ischial tuberosities varies between individuals. To this end the transverse support is designed as a rail 210 on which slides 280 can be displaced. The respective components 12 are positioned on the slides 280. Adjustment is performed by means of an appropriate mechanism, e.g. a threaded rod drive 281/280*c* which varies the spacing between the slides 280. In this case the threaded rod 281 is designed to have the opposite pitch in those areas which are assigned to the respective slides 280*a* or 280*b*. In the embodiment shown in FIGS. 2*b* and 2*c* the mechanism comprises a hand wheel 280*c* with which the threaded rod 281 can be turned. In an embodiment which is not illustrated a lever construction may be used and this can also be adjusted by means of a threaded rod, A simple electromotive or hydraulic or pneumatic adjustment device forms part of the engineer's specialist knowledge.

FIG. 2*d* shows an embodiment of the slide 280 as a dovetail guide 36 which connects the seat half 5*a* and the transverse support 21 and permits translation in the x direction to vary the spacing between the seat halves.

FIG. 3*a* shows tilting mechanisms 7 for the coupling device 6 in a side view or viewed along the x-z plane. In this case two alternative embodiments A and B are reproduced, each with a joint 28 fora seat half 5*a*, 5*b*, both alternatives comprising a seat half 3*a*, 5*b*, transverse support 21, longitudinal support 22, a component 12 and a coupling joint 23 between the transverse support 21 and the longitudinal support 22. The joint 23 is designed as a rubber block 15 and assumes both a movement and a damping function. By exchanging the longitudinal support 22 and the rubber block 15, direct fixing to the intermediate piece 3 can be replaced by indirect fixing.

In Version A the joint 28 is located between the transverse support 21 and the component 12, whereas in Version B it is arranged between the seat half 5*b* and the component 12. The joints 28 are semi-cylindrical in form. They may display a different form in alternatives which are not shown, e.g. a spherical or different spatial form, which forms facilitate the desired rocking motion. For stability reasons, each seat half per transverse verse support 21 comprises a joint 28. The tilting mechanism 7 thus makes it possible for the seat halves 5*a*, 5*b* to rotate around the y axis. The overall arrangement, which is similar to a pair of scales, can be moved as a whole such that the seat halves can be rotated due to the coupling joint 23 between the transverse support 21 and the longitudinal support 22, with the result that the seat halves can be moved vertically in the z direction.

In this case a movement mechanism 16', 26' may be provided to adjust the variable stops 16 and/or the fitting elements 26, with which mechanism the extent of the possible movement can be adjusted. This may be a simple spindle mechanism, by means of which the stops 16 can be moved up and down, or the fitting elements 26 can be inserted to a variable depth into the gap between the transverse support 21 and the concave support at the end of the intermediate piece 3. Retention devices are provided in the pivot bearings illustrated in FIGS. 1 to 3 and these devices guarantee that the respective structural components are retained in their functional positions with respect to one another and are still able to execute the desired movements. These retainers are not illustrated in the figures.

To permit independent vertical movement of the individual seat halves 5*a*, 5*b*, FIG. 4 shows how the movement in the z direction can be achieved by means of hydraulic cylinders 24. Another pair of cylinders (not illustrated) is located on the second transverse support, for purposes of height adjustment or tilting around the x axis, with the result that two hydraulic cylinders per transverse support and per seat half guarantee the desired freedom of movement. Each seat half can also be rotated around all other spatial axes by means of the illustrated arrangement. The cylinders 24 are positioned beneath the seat half 5*a* or on the component 12 and spaced apart from each other in the x direction. All cylinders fora seat half are connected to each other by means of fluid lines 11. The cylinder movement or the flow of fluid is restricted by the adjustment mechanism 8, making it possible to make the movement of the seat halves easier, harder or fixed. The adjustment mechanism 8 provides a fluid reserve with which the height adjustment or tilting motion can be individually regulated. The desired adjustments for the adjustment mechanism 8 are made via the lever 27. Pelvic misalignments can for example be corrected by the seat device 1 thanks to the facility for presetting and/or restricting the movement of the seat half 5*a*. Alternatively, a fixed bearing may replace a pair of hydraulic cylinders in a transverse support in a seat half. Although this still makes it possible to adjust the inclination, height adjustment is no longer possible. The fluid lines 11 of the individual seat halves 5*a*, 5*b* may be connected to enable the seat halves to be moved interdependently. Instead of the hydraulic cylinders, fluid-filled chambers which may be conductively connected to each other in some cases are positioned under each seat half, acting in the same way as a water bed.

FIG. 5 shows another embodiment of a tilting mechanism 7, Unlike in FIG. 4, the hydraulic cylinders are replaced by springs 13. Although it is not possible to adjust the height of a seat half by means of the springs, the ability to tilt can still be provided by varying the spring thicknesses. In FIG. 5 the locking mechanism is also in the form of a foam block 29 of variable hardness according to personal discretion. Rotation and translation can be made easier or harder by means of various forms, hardness levels, widths and thicknesses (not illustrated). Seat comfort can thus be influenced too. The seat half is pressed back into the initial position due to the permanent action of the spring force. The springs 13 accordingly act as a reset mechanism 9. In addition, it is also possible to use only springs, these being arranged at different angles between the seat surface and the transverse support, as illustrated by spring 34 for example.

FIG. 6 shows an alternative reset mechanism 9. In this case the seat half 5*a* is clamped via a tension strap 14 onto a circular, spherical or semi-cylindrical component 30. In this process the tension strap 14 is guided through a hole 140 which runs through the component 30, the seat half 5*a* and the transverse support 21. In this case the seat half rests on the semi-cylindrical component 30, the convex section facing the seat half 5*a*. An adjustment device 25 is located beneath the transverse support 21, the tension of the tension strap 14 being adjusted by means of this device. The adjustment device 25 comprises a cylinder with an external thread 31, through which cylinder the tension strap 14 is inserted. Another cylinder with an internal thread 32 engages with the thread of the cylinder 31 and the tension strap 14, which in turn comprises reinforcements at its ends, is fixed to the lower end of this other cylinder. By turning the lower hollow cylinder 32 onto the other cylinder 31, the spacing between the ends of the tension strap is altered and the tension is thus varied. The force of the reset mechanism 9 can thus be adjusted to change the position of the seat half 5*a* by means of the adjustment device 25.

FIG. 7 shows a coupling device 6 with seat half 5*a*. The seat half is positioned on a rubber block 15 which is connected to a plate 33 and which allows the seat half the required degrees of mobility. The plate 33 is located in a recess in the transverse support 21 and may be lowered or raised via an adjustment device 35 in the recess. The adjustment device 35 is in the form of a set screw which engages with a thread which is cut into the transverse support 21, The degree of rotation and the translation or three-dimensional movement of the seat half 5*a* are regulated by means of the retractable arrangement, where a fully retracted rubber block 15 does not allow any mobility and a rubber block extended to its maximum permits the maximum possible movement.

FIG. 8 shows three alternatives A-C of the seat device according to the invention with sensors and a feedback device. Alternative A is equipped with a tilting-inclination sensor 37 which records the position of the seat half 5*a* or the ischial tuberosities from the inclination. LEDs 38 in different colours are positioned beneath the transverse support 21 to provide feedback on the seat position. These light up in accordance with the respective position of the seat halves. FIG. 10 shows a selection of different seat-half positions. In this drawing the seat surfaces in a) display a concave inclination (inwards), causing the LEDS to display a red light (cross in FIG. 9 a)) as this causes the ischial tuberosities to move closer together and thus leads to the undesirable outflare. On the other hand, the colour is shown as green (tick in FIG. 10 *b*)) if the seat surfaces are horizontal or pointing slightly outwards (convex). An excessively convex inclined arrangement of the seat surfaces leads to an undesirable sitting position, causing the LEDs 38 to light up in orange to remind the user to sit correctly (FIG. 10 *c*)). White LEDs are provided to indicate synchronous inclination of the seat surfaces (equal sign in FIG. 10 *d*)). The user is thus constantly informed whether his/her sitting posture or pelvic position is correct.

Alternative B from FIG. 9 shows a loudspeaker 39 beneath the transverse support 21, which generates different warning signals for the seat half options described above. A vibration element can also be provided instead of the loudspeakers, which element informs the user about his sitting position via haptics. A haptic element is preferably located close to, on or in at one least one seat half.

In Alternative C in FIG. 9 the seat device is connected to a computer 40 which informs the user about his/her sitting position by means of software. The information is conveyed to the user in such a way that the screen shows how he/she should behave in order to achieve a better sitting position. The connection to the computer is via wireless technology, e.g. Bluetooth. Cable connection is also possible.

FIG. 10 shows a locking device for the movement of the seat halves with respect to each other. Such a locking device makes it possible to deactivate mobility of the seat halves so that the chair can occasionally be used by users who do not require the mobility aspects for a variety of reasons.

In the illustrated embodiment locking recesses (301*a;* 301*b*) are located beneath the seat halves (5*a*, 5*b*), and these interact with movable locking rods (300). In this case the locking recesses (301*a;* 301*b*) are positioned on the seat halves in duplicate, but only one central locking device may be provided if dimensioned appropriately. The two locking rods (300) can be moved by a shared actuation rod (302) in the illustrated example. In the position shown, the rods are in the locking position. If the rods (300) are pulled to the right in the X direction, the end of the locking rod (300) leaves the locking recess (301*a*) with the result that both seat halves (5*a*, 5*b*) are disconnected and can once again move freely.

Such a locking device is not restricted to the illustrated embodiment. Thus, in some cases the actuating rod may actuate the locking rods via an articulated lever so as to avoid excessive protrusion over the seat surface.

In a simplified embodiment individual locking rods may be used instead of a shared rod arrangement, which individual locking rods can be pulled completely out of locking holders which extend over the entire width of the seat halves (not illustrated).

The form of the invention is not limited to the preferred embodiments described above. Instead, there are a number of conceivable alternatives which make use of the illustrated solution even in embodiments which are fundamentally different. Thus, in the protective scope of the described invention for example the individual embodiments may be combined, so that hydraulic cylinders may also be arranged in the embodiment shown in FIG. 7 for example. Gel or foam materials may also be used for the components 12 in addition to rubber. In addition, a gel cushion which permits a three-dimensional freedom of movement may be arranged in FIG. 8 for example. The component 20 may also be added to the specified embodiments. A combination of several sensors with haptic and/or acoustic and/or optical elements may also be used to display the seat position.

The invention claimed is:

1. A rocking stool, comprising:

a seat rocking around a pendulum joint, configured for stationary engagement with a floor a foot part, a columnar intermediate piece connected to the foot part, and a spring surrounding the intermediate piece for allowing the seat to move upwardly and downwardly;

wherein the pendulum joint is provided between the columnar intermediate piece and the such that the columnar intermediate piece rocks around the pendulum joint foot part, wherein the seat is connected to the intermediate piece and formed by two individual seat halves positioned next to each other, wherein:

the seat halves are movable independently of each other, a coupling device is provided between the seat and the intermediate piece, and the seat halves are movable in a horizontal translational motion through the coupling device, the coupling device comprises at least one means for moving the seat halves by a translational movement in all spatial directions and rotationally around all spatial axes, the at least one means being provided beneath each seat half, and the coupling device comprises a mechanism for adjusting the horizontal spacing between the seat halves.

2. The seat device according to claim 1, wherein the at least one means comprises at least one elastic component.

3. The seat device according to claim 2, wherein the at least one elastic component comprises a fluid-filled chamber or hydraulic cylinders.

4. Seat device according to claim 1, wherein the coupling device comprises a mechanism for adjusting the height of the seat halves.

5. The seat device according to claim 1, wherein the coupling device comprises at least one tilting mechanism for at least one seat half.

6. Seat device according to claim 5, wherein the inclination of at least one seat half can be preset and/or restricted by means of an adjustment mechanism located on the coupling device and/or on the tilting mechanism.

7. Seat according to claim 1, wherein a reset mechanism returns at least one seat half to its initial position.

8. Seat device according to claim 1, wherein the seat device records the seat position by means of at least one sensor and comprises a feedback facility.

9. The seat device according to claim 1, further comprising at least one of variable stops and modifiable fitting elements for interacting with transverse supports of the coupling device to restrict mobility.

10. The seat device according to claim 9, further comprising a movement mechanism for adjusting the at least one of the variable stops and the modifiable fitting elements.

11. The seat device according to claim 1, wherein the mechanism for adjusting the horizontal spacing between the seat halves comprises: a rail; a pair of slides slidable along the rail; and a threaded rod drive for varying the horizontal spacing between the slides, wherein each slide is connected to a respective seat halve for translating the movement of the slide to the respective seat halve.

* * * * *